US011850607B2

(12) United States Patent
Wang et al.

(10) Patent No.: US 11,850,607 B2
(45) Date of Patent: Dec. 26, 2023

(54) SHOWER DEVICE

(71) Applicant: Xiamen Lota International Co., Ltd., Fujian (CN)

(72) Inventors: Xuedong Wang, Fujian (CN); Jiangcheng Zhang, Fujian (CN); Zhixin Lin, Fujian (CN); Hong Zhang, Fujian (CN); Chuanbao Zhu, Fujian (CN)

(73) Assignee: Xiamen Lota International Co., Ltd., Fujian (CN)

( * ) Notice: Subject to any disclaimer, the term of this patent is extended or adjusted under 35 U.S.C. 154(b) by 395 days.

(21) Appl. No.: 17/139,070

(22) Filed: Dec. 31, 2020

(65) Prior Publication Data

US 2021/0197216 A1 Jul. 1, 2021

(30) Foreign Application Priority Data

Dec. 31, 2019 (CN) ..... 201911413059.2

(51) Int. Cl.
*B05B 1/16* (2006.01)
*B05B 1/18* (2006.01)
*B05B 12/00* (2018.01)

(52) U.S. Cl.
CPC ..... *B05B 1/1663* (2013.01); *B05B 1/185* (2013.01); *B05B 12/002* (2013.01)

(58) Field of Classification Search
CPC ..... B05B 1/1663; B05B 1/185; B05B 12/002
USPC ..... 239/443
See application file for complete search history.

(56) References Cited

U.S. PATENT DOCUMENTS 7,299,510 B2 * 11/2007 Tsai ..... E03C 1/023 4/615
7,308,724 B2 * 12/2007 Ho ..... E03C 1/00 4/603
7,360,723 B2 * 4/2008 Lev ..... E03C 1/0408 239/443
7,448,403 B2 * 11/2008 Shien ..... F16K 11/0445 4/615
7,694,359 B1 * 4/2010 Hall ..... E03C 1/0408 4/615
7,857,241 B2 * 12/2010 Deng ..... E03C 1/0408 239/443
7,937,784 B2 * 5/2011 Qiu ..... B05B 1/18 4/615
9,707,574 B2 * 7/2017 Soetaert ..... E03C 1/0408

* cited by examiner

*Primary Examiner* — Chee-Chong Lee
(74) *Attorney, Agent, or Firm* — COOPER LEGAL GROUP, LLC

(57) ABSTRACT

A shower device is provided. The shower device comprises a top shower, a diverting valve core, a switching assembly, a handheld shower, and a pause valve core. The switching assembly is configured to control the diverting valve core to be switched between the normal diverting state and forced diverting state.

13 Claims, 13 Drawing Sheets

SHOWER DEVICE

RELATED APPLICATIONS

This application claims priority to Chinese patent application number 201911413059.2, filed on Dec. 31, 2019. Chinese patent application number 201911413059.2 is incorporated herein by reference.

FIELD OF THE DISCLOSURE

The present disclosure relates to a shower device.

BACKGROUND OF THE DISCLOSURE

Existing shower devices comprise a top shower, a handheld shower, and a switching structure. However, in the existing shower devices, a limited number of water outlet modes (i.e., water discharging modes) can be selected, the switching structure is complicated, and the switching is inconvenient.

BRIEF SUMMARY OF THE DISCLOSURE

The present disclosure provides a water device to solve the deficiencies in the background.

In order to solve the technical problem, a technical solution of the present disclosure is as follows.

A shower device comprises a top shower, a diverting valve core, a switching assembly, a handheld shower, and a pause valve core. The top shower comprises a water inlet passage, a top shower water outlet passage, a diverting valve cavity, and a flow passage, and the water inlet passage is in communication with the top shower water outlet passage and the flow passage through the diverting valve cavity. The diverting valve core is disposed in the diverting valve cavity and comprises a normal diverting state and a forced diverting state. The switching assembly is disposed on the top shower and is configured to control the diverting valve core to be switched between the normal diverting state and forced diverting state. The handheld shower comprises a handheld shower water outlet passage in communication with the flow passage. The pause valve core is disposed on the handheld shower to open or close the handheld shower water outlet passage.

In a preferred embodiment, the diverting valve core comprises a diverting valve shaft, a diverting valve body, a diverting sealing pad, and a deformation portion, and the diverting sealing pad and the deformation portion are respectively secured to two ends of the diverting valve shaft. The diverting valve body is secured in the diverting valve cavity and comprises a diverting inlet in communication with the water inlet passage. An inner side of the diverting valve body comprises a carrier cavity, and the carrier cavity penetrates through the diverting valve body and is in communication with the diverting inlet. The diverting valve shaft is configured to move along a longitudinal direction of the carrier cavity. The diverting sealing pad and the deformation portion are respectively positioned on two ends of the carrier cavity. When the diverting valve core is in the normal diverting state, the diverting sealing pad is separated from a first opening of the carrier cavity adjacent to the diverting sealing pad and the deformation portion is hermetically disposed on a second opening of the carrier cavity adjacent to the deformation portion, or the diverting sealing pad is hermetically disposed on the first opening of the carrier cavity adjacent to the diverting sealing pad and the deformation portion is separated from the second opening of the carrier cavity adjacent to the deformation portion. When the diverting valve core is in the forced diverting state, the diverting sealing pad is separated from the first opening of the carrier cavity adjacent to the diverting sealing pad and the deformation portion is separated from the second opening of the carrier cavity adjacent to the deformation portion.

In a preferred embodiment, the diverting valve shaft comprises a positioning portion. The switching assembly comprises a switching shaft configured to move relative to the top shower, and the switching shaft moves between a separating position in which the switching shaft is separated from the positioning portion and a positioning position in which the switching shaft cooperates with the positioning portion. When the switching shaft is in the positioning position, the diverting valve shaft is secured to prevent movement of the diverting valve shaft to enable the diverting valve core to be in the forced diverting state. When the switching shaft is in the separating position, the diverting valve shaft is configured to move to enable the diverting valve core to be in the normal diverting state due to water pressure.

In a preferred embodiment, the positioning portion defines a positioning hole and cooperates with the diverting inlet, and a tail end of the switching shaft passes through the diverting inlet and cooperates with the positioning hole.

In a preferred embodiment, a moving direction of the switching shaft is perpendicular to a moving direction of the diverting valve shaft.

In a preferred embodiment, an end surface of the positioning hole facing the switching shaft comprises a guide inclined surface configured to facilitate the switching shaft being disposed in the positioning hole.

In a preferred embodiment, the diverting valve core comprises a diverting elastic member, and the diverting elastic member abuts and is disposed between the diverting valve shaft and the diverting valve body.

In a preferred embodiment, the handheld shower comprises a pause valve cavity. The pause valve cavity comprises a pause inlet in communication with a front end of the handheld shower water outlet passage and a pause outlet in communication with a rear end of the handheld shower water outlet passage. The pause valve core comprises a pause valve shaft movably connected to the pause valve cavity and a pause sealing pad secured to the pause valve shaft. The pause sealing pad moves between a sealing position in which the pause outlet is hermetically sealed and an open position in which the pause outlet is open.

In a preferred embodiment, the pause valve cavity penetrates through the handheld shower upward and downward. The pause valve core comprises a first pause button and a second pause button, and the first pause button and the second pause button are respectively secured to an upper end and a lower end of the pause valve shaft.

In a preferred embodiment, the top shower comprises a switching cavity in communication with the diverting valve cavity. The switching assembly comprises a switching base, a switching button, an upper gear shaft, a lower gear shaft, and a switching elastic member. The switching base is secured in the switching cavity. The switching button is movably connected to the switching base. The upper gear shaft is disposed in the switching base and operatively cooperates with both of the switching button and the lower gear shaft. The lower gear shaft operatively cooperates with a switching shaft of the switching assembly. A tail end of the switching shaft is disposed in the diverting valve cavity. The switching elastic member abuts and is disposed between the switching shaft and the switching cavity.

Compared with the existing techniques, the technical solution has the following advantages.

1. When the user does not need the top shower and the handheld shower to discharge water at the same time, the user can simply switch the diverting valve core to the normal diverting state through the switching assembly. At this time, the user only controls the pause valve core to enable the top shower water outlet passage and the handheld shower water outlet passage to be alternatively switched to be in communication with the inlet passage. When the top shower and the handheld shower are required to discharge water at the same time, the diverting valve core can be switched to the forced diverting state through the switching assembly, and then the pause valve core is then controlled to cause water to flow out of the top shower and handheld shower at the same time or cause water to only flow out of the top shower. The water passage switching structure is simple, and there is no need to create a complicated switching structure between the top shower and the handheld shower. The pause valve core is disposed at the handheld shower, so the switching is convenient. At the same time, there are various water discharging modes, which can be used alone or simultaneously.

2. By separating the switching shaft from or positioning the switching shaft to the positioning portion, the diverting valve shaft can be moved by water pressure or be secured to prevent movement of the diverting valve shaft. When the diverting valve core is in the normal diverting state, the diverting valve shaft can be moved under water pressure. When the diverting valve core in a forced diverting state, diverting valve shaft is fixed. At this time, water flows out of both the top shower and the handheld shower. The switching structure is simple and the switching method is novel. It is original by controlling the movement of the diverting valve shaft to switch the water discharging mode.

DETAILED DESCRIPTION OF THE EMBODIMENTS

Figure 1:
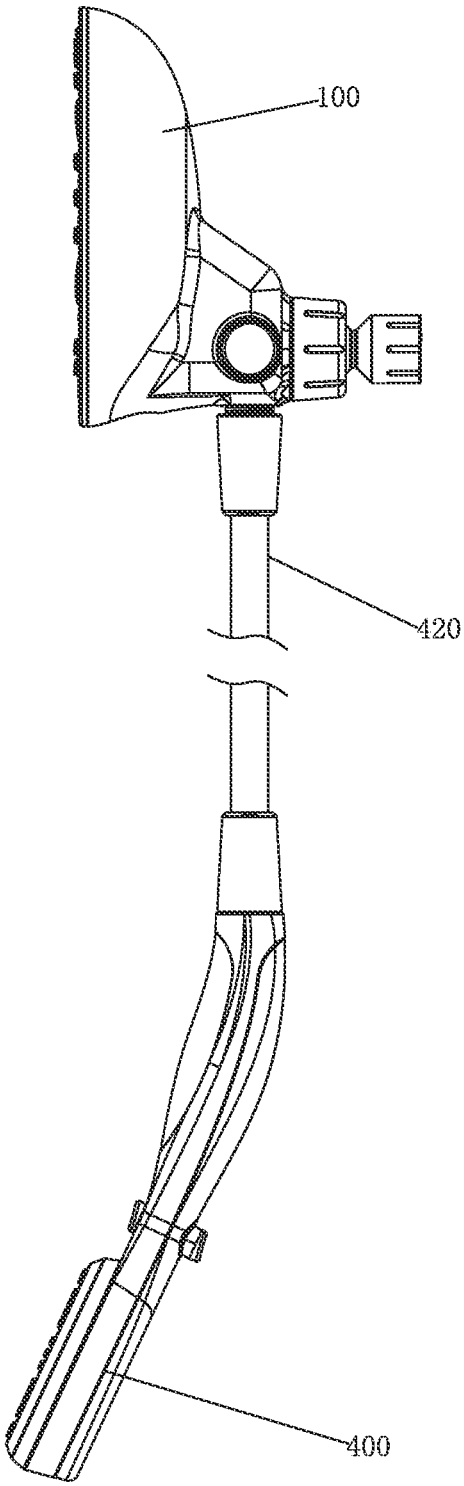
FIG. 1 illustrates a side view of a shower device according to an embodiment.

The present disclosure will be further described below in combination with the accompanying drawings and embodiments.

Referring to FIGS. 1-17, an embodiment of a shower device is provided. The shower device comprises a top shower 100, a diverting valve core 200, a switching assembly 300, a handheld shower 400, and a pause valve core 500.

The top shower 100 comprises a water inlet passage 110, a top shower water outlet passage 120, a diverting valve cavity 130, and a flow passage 140, and the water inlet passage 110 is in communication with the top shower water outlet passage 120 and the flow passage 140 through the diverting valve cavity 130.

In this embodiment, the top shower 100 is further disposed with a switching cavity 150 in communication with the diverting valve cavity 130.

The diverting valve core 200 is disposed in the diverting valve cavity 130 and comprises a normal diverting state and a forced diverting state.

In this embodiment, the diverting valve core 200 comprises a diverting valve shaft 210, a diverting valve body 220, a diverting sealing pad 230, and a deformation portion 240, and the diverting sealing pad 230 and the deformation portion 240 are respectively secured to two ends of the diverting valve shaft 210. The diverting valve body 220 is secured in the diverting valve cavity 130 and comprises a diverting inlet 221 in communication with the water inlet passage 110. An inner side of the diverting valve body 220 comprises a carrier cavity 222 that penetrates through the diverting valve body 220 and is in communication with the diverting inlet 221. The diverting valve shaft 210 is configured to move along a longitudinal direction of the carrier cavity 222, and the diverting sealing pad 230 and the deformation portion 240 are respectively positioned on two ends of the carrier cavity 222. When the diverting valve core 200 is in the normal diverting state, the diverting sealing pad 230 is separated from a first opening 2221 of the carrier cavity 222 adjacent to the diverting sealing pad 230 and the deformation portion 240 is hermetically disposed on a second opening 2222 of the carrier cavity 222 adjacent to the deformation portion 240, or the diverting sealing pad 230 is hermetically disposed on the first opening 2221 of the carrier cavity 222 adjacent to the diverting sealing pad 230 and the deformation portion 240 is separated from the second opening 2222 of the carrier cavity 222 adjacent to the deformation portion 240. When the diverting valve core 200 is in the forced diverting state, the diverting sealing pad 230 is separated from the first opening 2221 of the carrier cavity 222 adjacent to the diverting sealing pad 230 and the deformation portion 240 is separated from the second opening 2222 of the carrier cavity 222 adjacent to the deformation portion 240.

In this embodiment, the diverting valve core 200 further comprises a diverting elastic member 250. The diverting elastic member 250 abuts and is disposed between the diverting valve shaft 210 and the diverting valve body 220. In some embodiments, the diverting elastic member 250 encompasses an outer side of the diverting sealing pad 230, and two ends of the diverting elastic member 250 respectively abut an end of the diverting valve shaft 210 adjacent to the diverting sealing pad 230 and a cavity wall of the carrier cavity 222.

Figure 4:
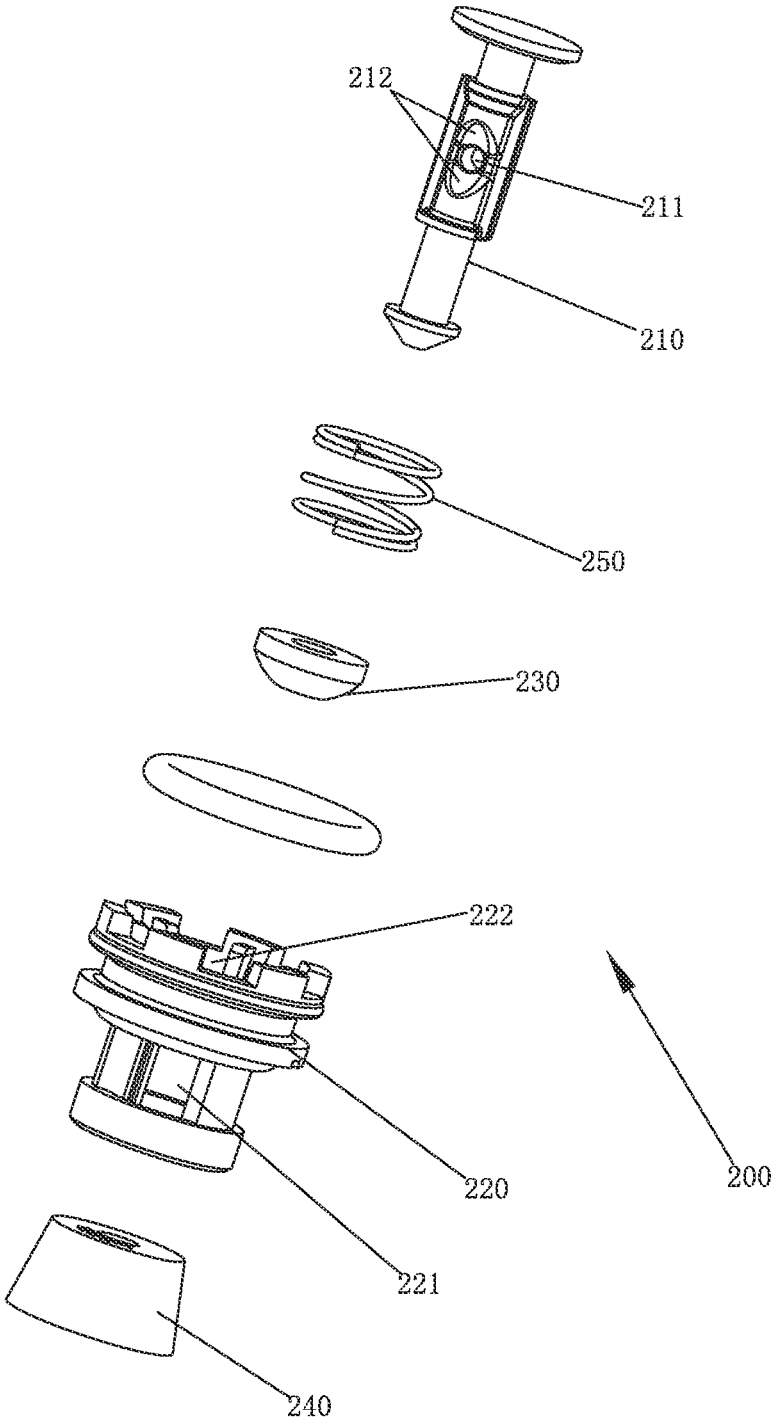
FIG. 4 illustrates an exploded perspective view of a diverting valve core.
Figure 5:
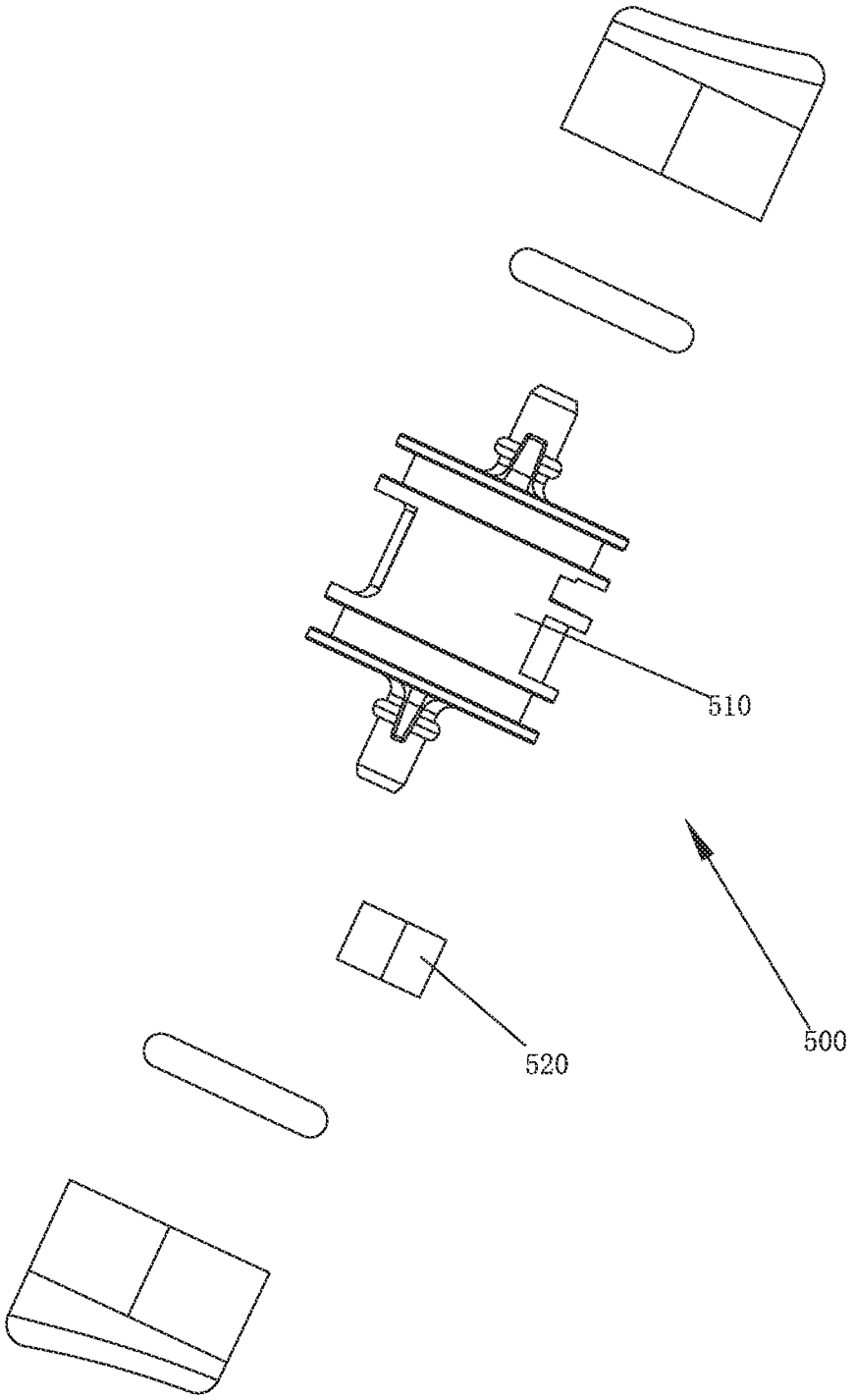
FIG. 5 illustrates an exploded perspective view of a pause valve core.
Figure 6:
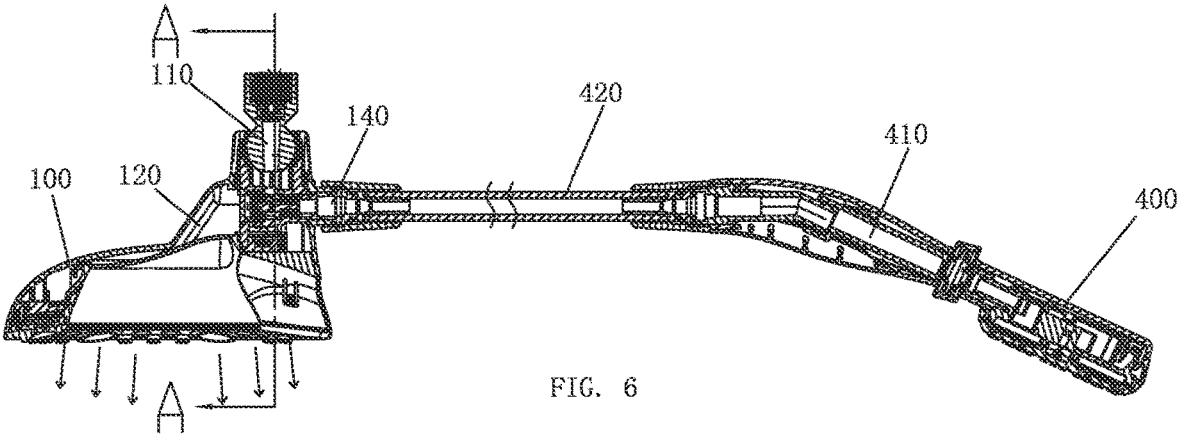
FIG. 6 illustrates a water discharging mode when a switching shaft is in a separating position and a pause sealing pad is in a sealing position.
Figure 7:
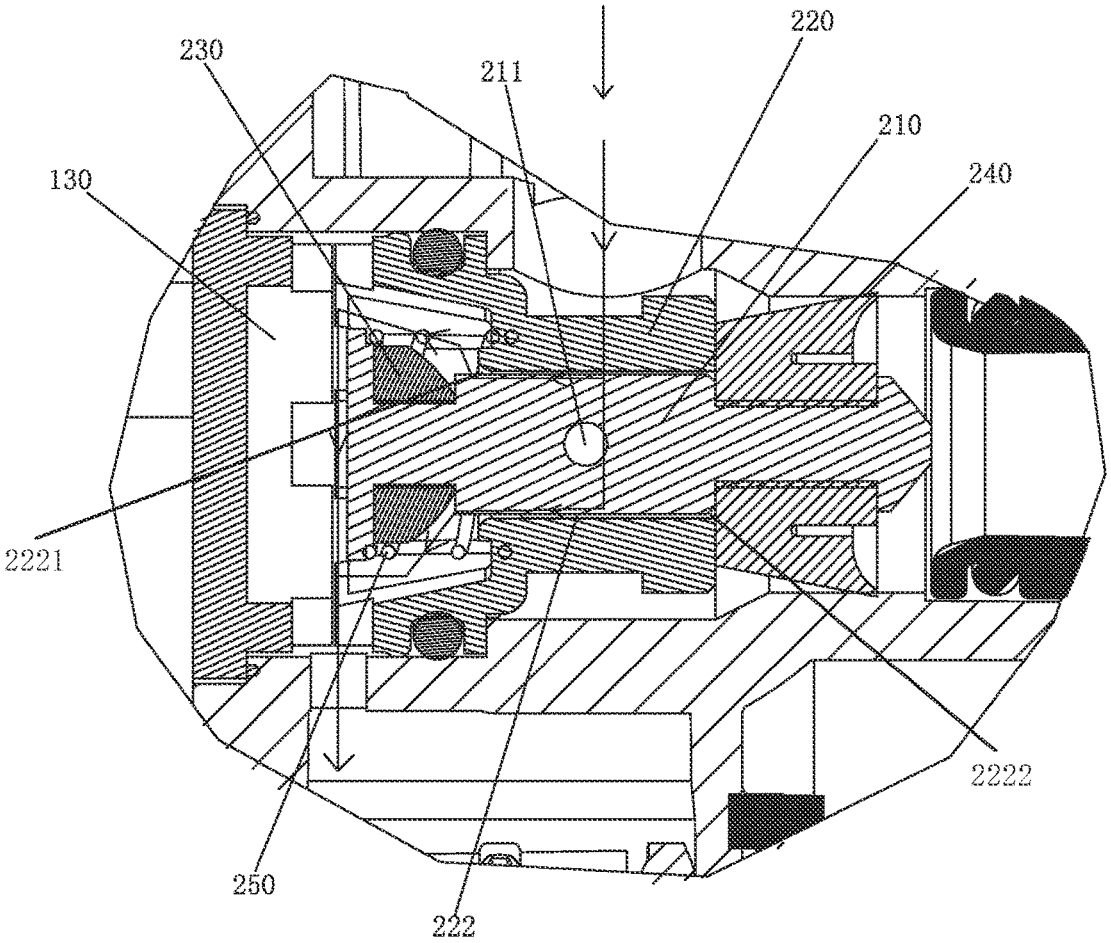
FIG. 7 illustrates a cross-sectional view of the diverting valve core in FIG. 6.

In this embodiment, the diverting valve shaft 210 comprises a positioning portion. Referring to FIG. 4, the positioning portion defines a positioning hole 211 and cooperates with the diverting inlet 221. Referring to FIG. 7, the positioning hole 211 is disposed on a middle position of the diverting valve shaft 210 and is disposed between the diverting sealing pad 230 and the deformation portion 240. In this embodiment, an end surface of the positioning hole 211 facing a switching shaft 310 comprises a guide inclined surface 212 configured to facilitate the switching shaft 310 being disposed in the positioning hole 211.

The switching assembly 300 is disposed on the top shower 100 and is configured to control the diverting valve core 200 to be switched between the normal diverting state and the forced diverting state.

In this embodiment, the switching assembly 300 comprises the switching shaft 310 configured to move relative to the top shower 100, and the switching shaft 310 moves between a separating position in which the switching shaft 310 is separated from the positioning portion and a positioning position in which the switching shaft 310 cooperates with the positioning portion. When the switching shaft 310 is in the positioning position, the diverting valve shaft 210 is secured to prevent movement of the diverting valve shaft 210 to enable the diverting valve core 200 to be in the forced diverting state. When the switching shaft 310 is in the separating position, the diverting valve shaft 210 is configured to move to enable the diverting valve core 200 to be in the normal diverting state due to water pressure.

In this embodiment, a tail end of the switching shaft 310 passes through the diverting inlet 221 and cooperates with the positioning hole 211.

In this embodiment, a moving direction of the switching shaft 310 is perpendicular to a moving direction of the diverting valve shaft 210, so that a positioning cooperation between the switching shaft 310 and the diverting valve shaft 210 is faster and more stable. As desired, the moving direction of the switching shaft 310 can be designed to be not perpendicular to the moving direction of the diverting valve shaft 210. For example, an included angle between the switching shaft 310 and the diverting valve shaft 210 can be an acute angle or an obtuse angle, but the disclosure is not limited thereto.

In this embodiment, the switching assembly 300 further comprises a switching base 320, a switching button 330, an upper gear shaft 340, a lower gear shaft 350, and a switching elastic member 360. The switching base 320 is secured in the switching cavity 150, and the switching button 330 is movably connected to the switching base 320. The upper gear shaft 340 is disposed in the switching base 320 and operatively cooperates with both of the switching button 330 and the lower gear shaft 350. The lower gear shaft 350 operatively cooperates with the switching shaft 310, and the tail end of the switching shaft 310 is disposed in the diverting valve cavity 130. The switching elastic member 360 abuts and is disposed between the switching shaft 310 and the switching cavity 150. A switching principle of the switching assembly 300 is the same as a switching principle of a ball-point pen core and will not be further described here. It is worthy to note that a switching sealing pad 370 is disposed between the upper gear shaft 340 and the switching base 320 to ensure that water does not flow out of the switching base 320.

Figure 2:
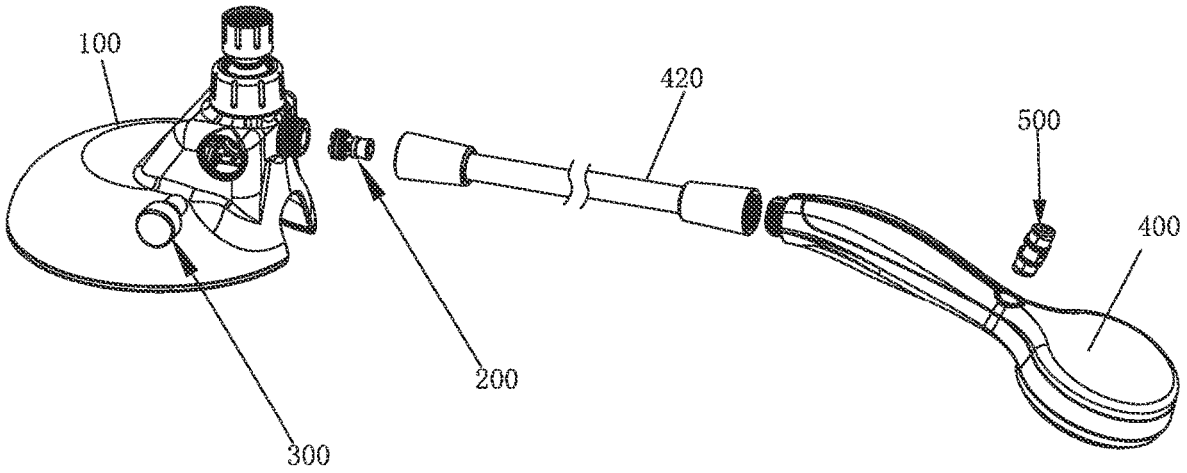
FIG. 2 illustrates an exploded perspective view of the shower device according to the embodiment.
Figure 3:
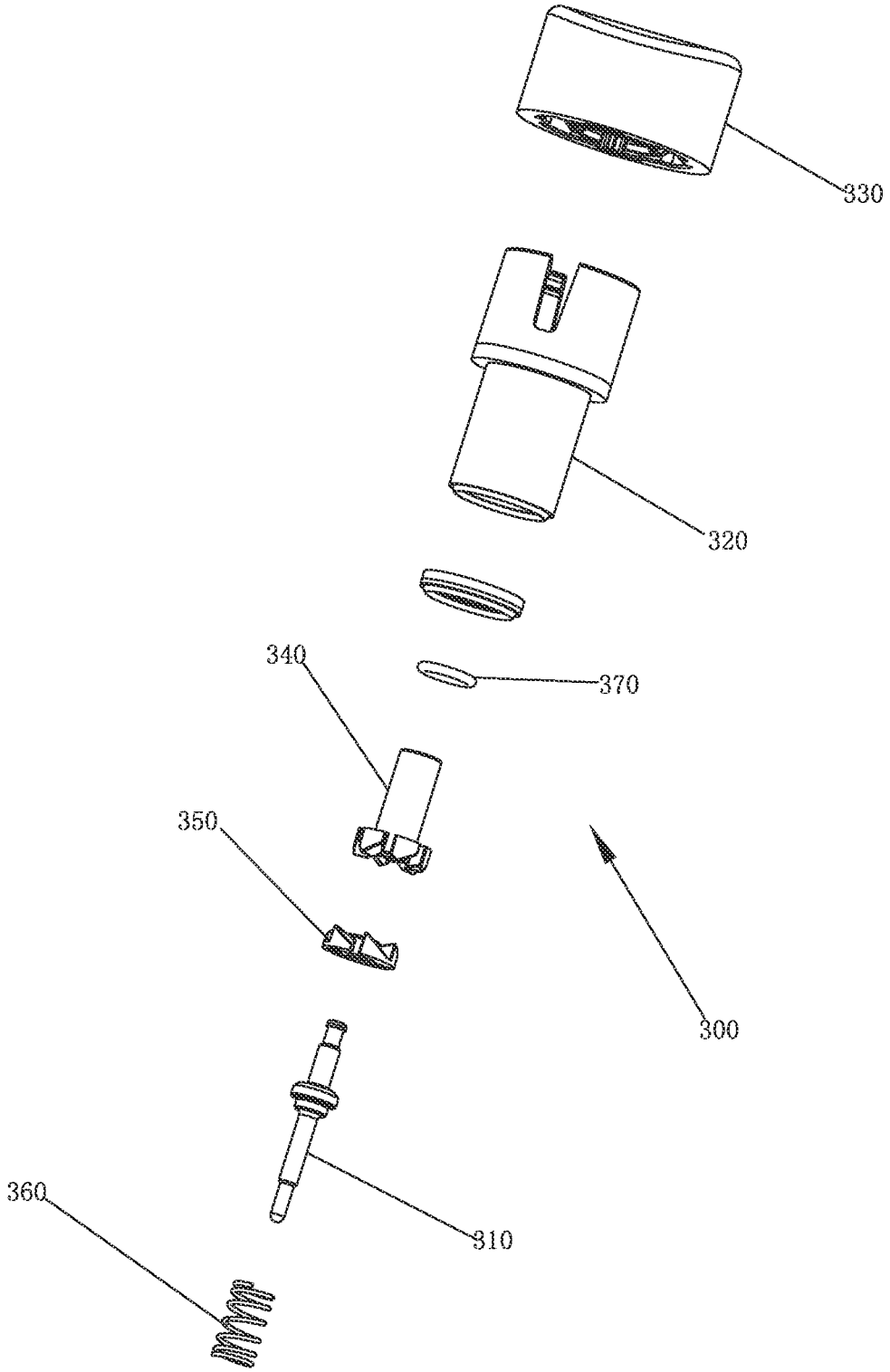
FIG. 3 illustrates an exploded perspective view of a switching assembly.

The handheld shower 400 comprises a handheld shower water outlet passage 410 in communication with the flow passage 140. Referring to FIG. 2, the handheld shower 400 is connected to the top shower 100 through a hose 420. That is, the hose 420 is in communication with the flow passage 140 and the handheld shower water outlet passage 410.

The pause valve core 500 is disposed on the handheld shower 400 to open or close the handheld shower water outlet passage 410.

In this embodiment, the handheld shower 400 further comprises a pause valve cavity 430. The pause valve cavity 430 comprises a pause inlet 431 in communication with a front end of the handheld shower water outlet passage 410 and a pause outlet 432 in communication with a rear end of the handheld shower water outlet passage 410. The pause valve core 500 comprises a pause valve shaft 510 movably connected to the pause valve cavity 430 and a pause sealing pad 520 secured to the pause valve shaft 510. The pause sealing pad 520 moves between a sealing position in which the pause outlet 432 is hermetically sealed (i.e., closed) and an open position in which the pause outlet 432 is open.

Figure 8:
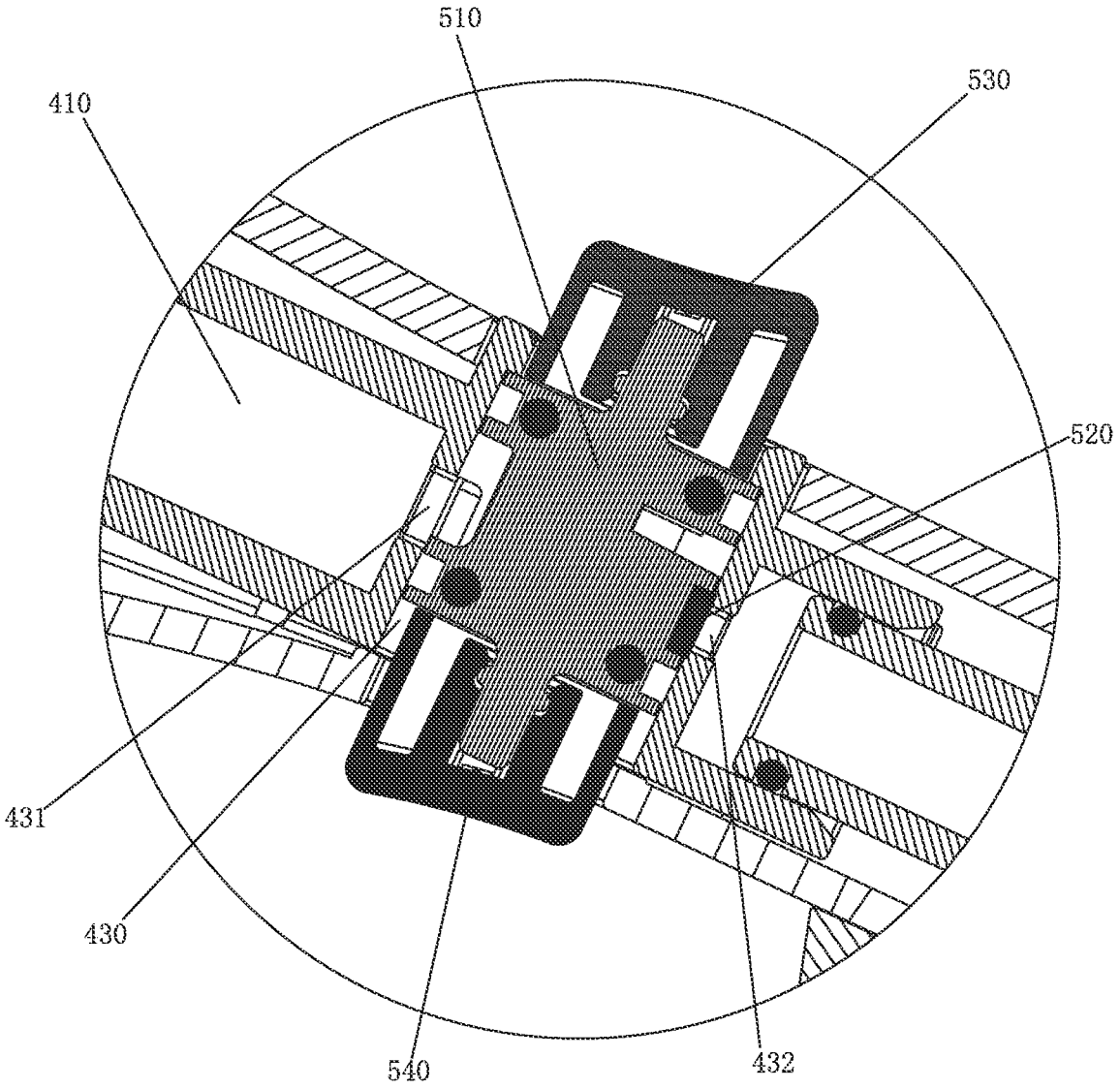
FIG. 8 illustrates a cross-sectional view of the pause valve core in FIG. 6.

In this embodiment, referring to FIG. 8, the pause valve cavity 430 penetrates through the handheld shower 400 upward and downward (i.e., in a vertical direction). The pause valve core 500 further comprises a first pause button 530 and a second pause button 540. The first pause button 530 and the second pause button 540 are respectively secured to an upper end and a lower end of the pause valve shaft 510.

Figure 12:
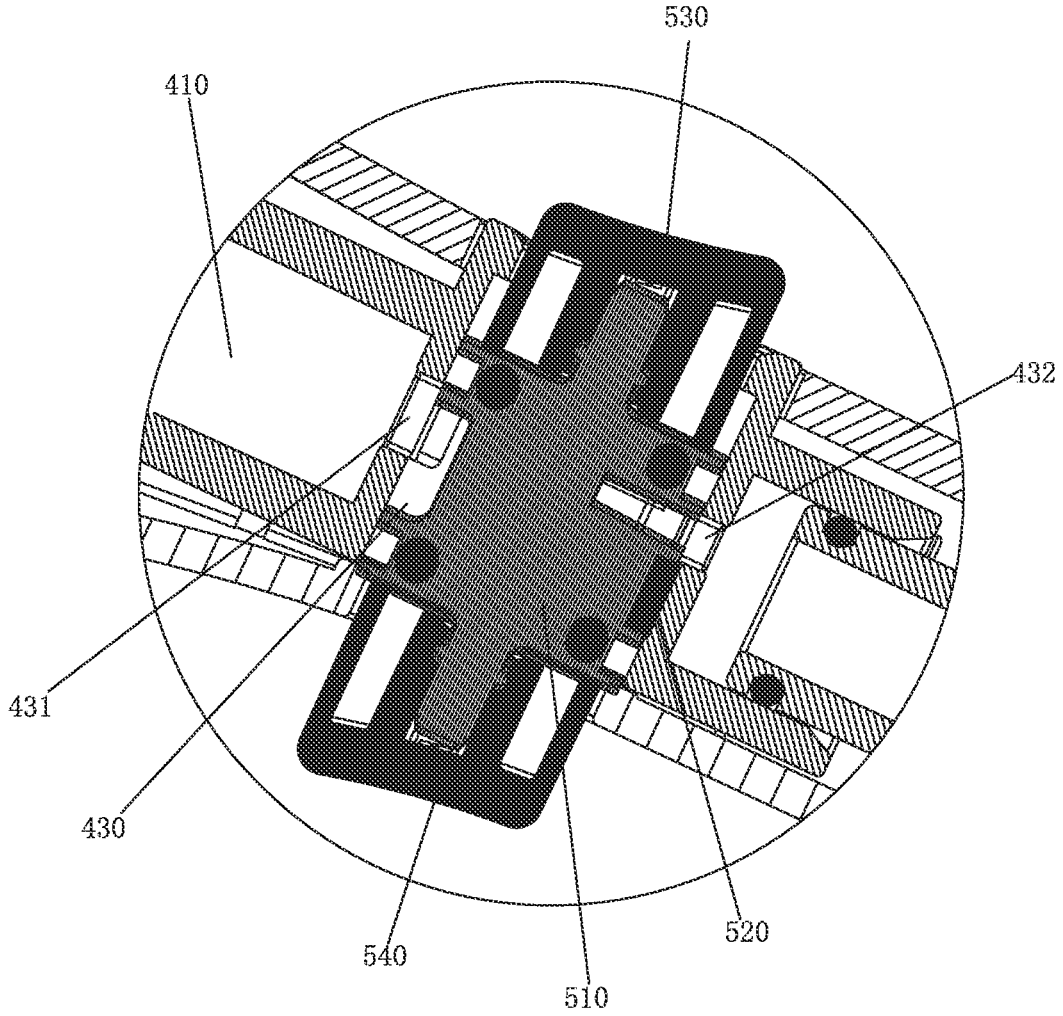
FIG. 12 illustrates a cross-sectional view of the pause valve core in FIG. 10.

A working principle of the pause valve core 500 is as follows. Referring to FIG. 8, the second pause button 540 is pressed upward to drive the pause valve shaft 510 and the pause sealing pad 520 to move upward synchronously until the pause sealing pad 520 moves to the sealing position in which the pause outlet 432 is hermetically sealed. At this time, the front end of the handheld shower water outlet passage 410 is not in communication with the rear end of the handheld shower water outlet passage 410. Referring to FIG. 12, the first pause button 530 is pressed downward to drive the pause valve shaft 510 and the pause sealing pad 520 to move downward synchronously until the pause sealing pad 520 moves to the open position in which the pause outlet 432 is open. At this time, the front end of the handheld shower water outlet passage 410 is in communication with the rear end of the handheld shower water outlet passage 410.

The shower device has four water discharging modes

A first water discharging mode of the four water discharging modes is shown in FIGS. 6-9.

Figure 9:
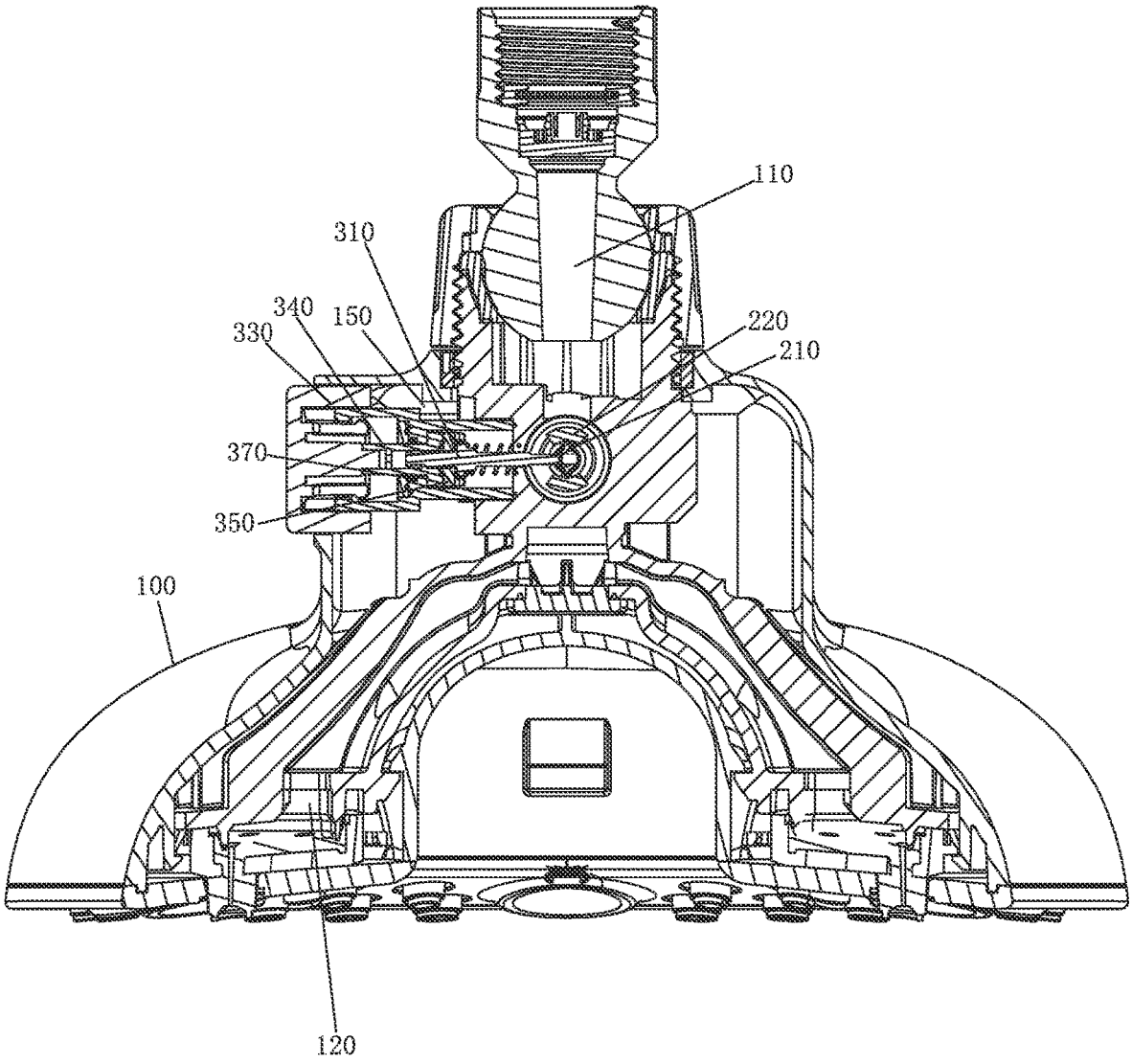
FIG. 9 illustrates a cross-sectional view of FIG. 6 taken along line A-A.

Referring to FIG. 9, when the switching shaft 310 is disposed in the separating position, that is, is separated from the positioning hole 211, there is no connection relationship between the switching assembly 300 and the diverting valve core 200, and the switching assembly 300 and the diverting valve core 200 are independent from each other. The diverting valve core 200 is the same as a conventional diverting valve core, and the diverting valve shaft 210 is configured to move due to water pressure, so that the diverting valve core 200 is in the normal diverting state. Referring to FIG. 8, the pause sealing pad 520 is disposed in the sealing position to enable the handheld shower water outlet passage 410 to be closed.

Referring to FIG. 7, a left end and a right end of the deformation portion 240 is subjected to the same water pressure. The deformation portion 240 maintains a normally open state to enable an inlet of the flow passage 140 to be hermitically sealed, while water pressure applied on a right end of the diverting sealing pad 230 is greater than water pressure applied on a left end of the diverting sealing pad 230, resulting in the diverting valve shaft 210 moving leftward due to a leftward total force. The diverting sealing pad 230 is separated from the first opening 2221 of the carrier cavity 222 adjacent to the diverting sealing pad 230, and the deformation portion 240 is just hermetically disposed on the second opening 2222 of the carrier cavity 222 adjacent to the deformation portion 240. Further, the diverting valve shaft 210 is maintained in this position due to the diverting elastic member 250. Water from the water inlet passage 110 flows into the carrier cavity 222 though the diverting inlet 221, then flows into the top shower water outlet passage 120 through the first opening 2221 of the carrier cavity 222 adjacent to the diverting sealing pad 230, and then flows out of the top shower water outlet passage 120.

Figure 10:
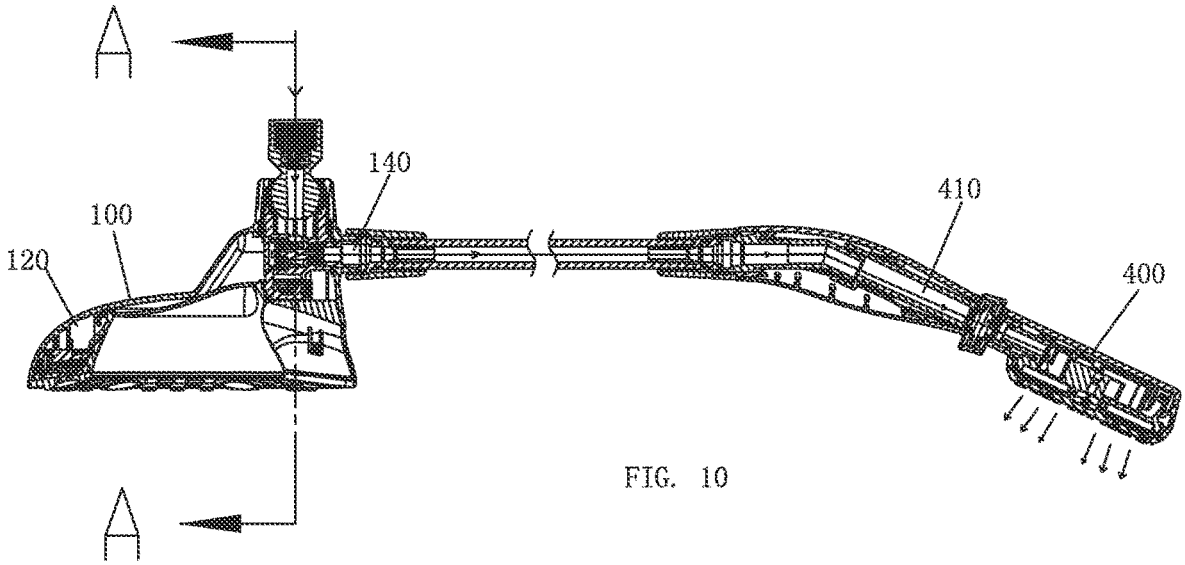
FIG. 10 illustrates a water discharging mode when the switching shaft is in the separating position and the pause sealing pad is in an open position.
Figure 11:
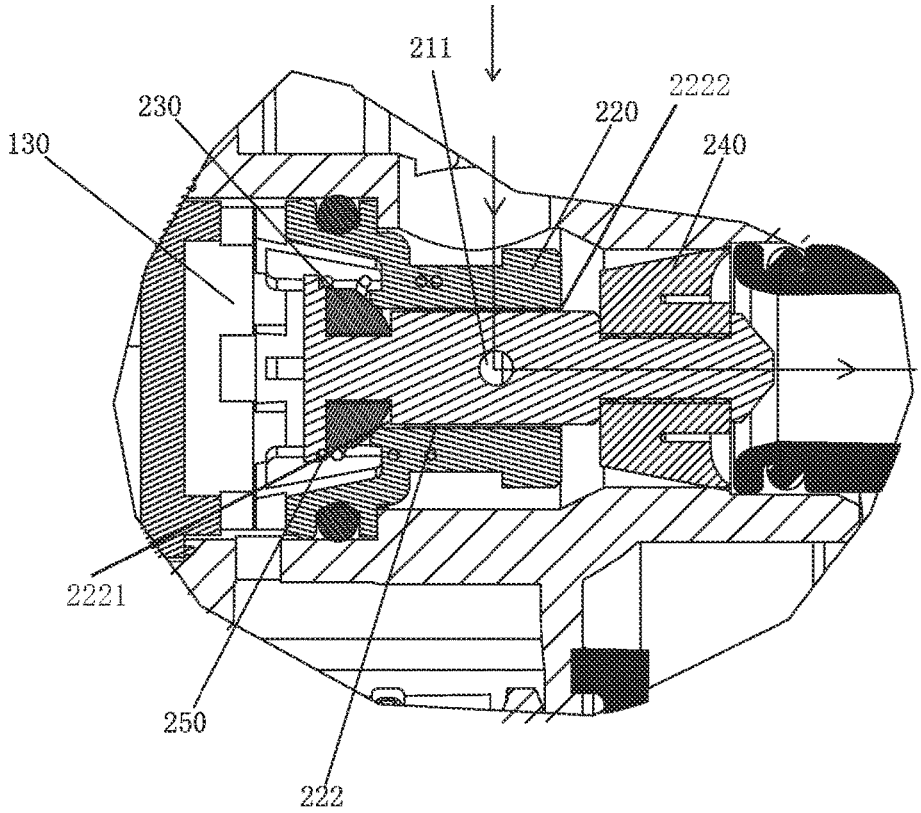
FIG. 11 illustrates a cross-sectional view of the diverting valve core in FIG. 10.

A second water discharging mode of the four water discharging modes is shown in FIGS. 10-12.

A position of the switching shaft 310 is the same as a position of the switching shaft 310 in the first water discharging mode. The switching shaft 310 is disposed in the separating position to enable the diverting valve core 200 to be in the normal diverting state. Referring to FIG. 12, the pause sealing pad 520 is disposed in the open position to cause the handheld shower water outlet passage 410 to be open.

Referring to FIG. 11, water pressure in the flow passage 140 is released, and the water pressure applied on the left end of the deformation portion 240 is greater than the water pressure applied on the right end of the deformation portion 240, so the deformation portion 240 is subjected to a rightward total force to drive the diverting valve shaft 210 and the diverting sealing pad 230 to move rightward. The diverting sealing pad 230 is hermetically disposed on the first opening 2221 of the carrier cavity 222 adjacent to the diverting sealing pad 230, and the deformation portion 240 is separated from the second opening 2222 of the carrier cavity 222 adjacent to the deformation portion 240. Further, the right end of the deformation portion 240 is deformed to shrink inward to reduce a diameter of the deformation portion 240 until the inlet of the flow passage 140 is open. The diverting elastic member 250 is compressed, water from the water inlet passage 110 flows into the carrier cavity 222 through the diverting inlet 221, then flows into the flow passage 140 through the second opening 2222 of the carrier cavity 222 adjacent to the deformation portion 240, then flows into the handheld shower water outlet passage 410 through the hose 420, and then flows out of the handheld shower water outlet passage 410.

Figure 13:
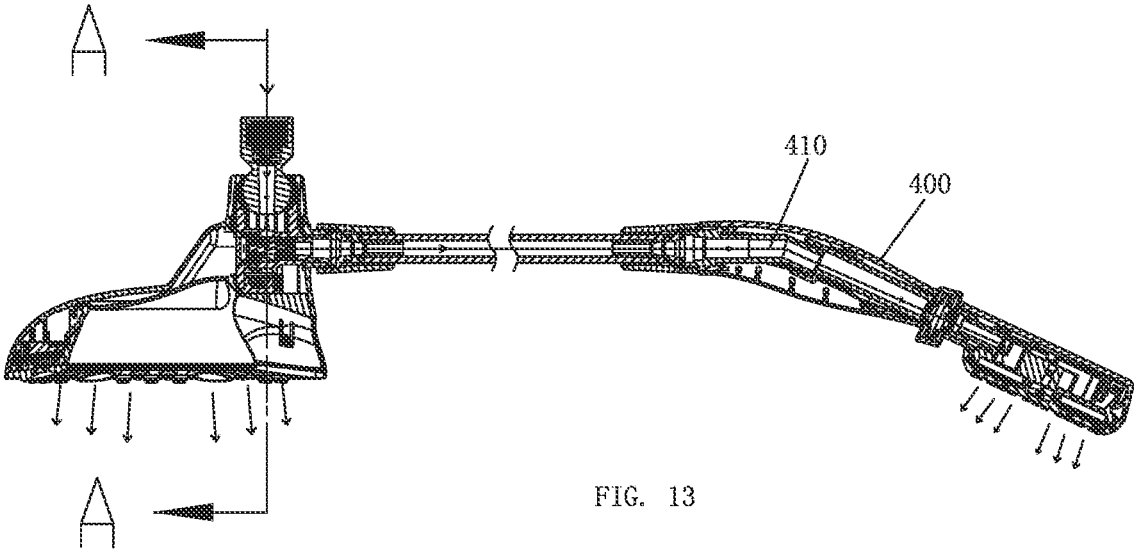
FIG. 13 illustrates a water discharging mode when the switching shaft is in a positioning position and the pause sealing pad is in the open position.
Figure 15:
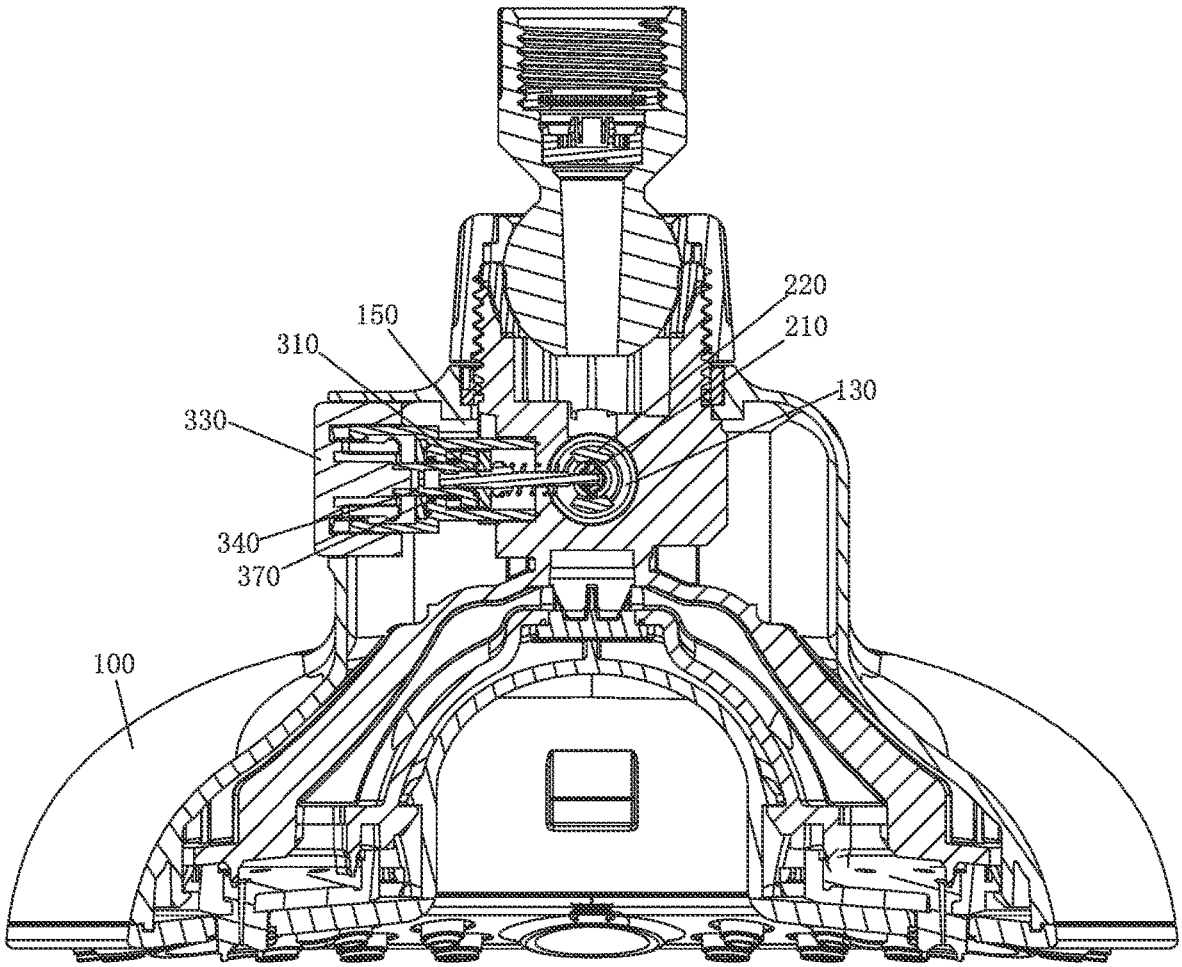
FIG. 15 illustrates a cross-sectional view of FIG. 13 taken along line A-A.

A third water discharging mode of the four water discharging modes is shown in FIG. 13 and FIG. 15.

Referring to FIG. 15, the switching shaft 310 is in the positioning position. That is, the switching shaft 310 is disposed in the positioning hole 211. The diverting valve shaft 210 is secured by the switching shaft to prevent movement of the diverting valve shaft 210. The diverting valve shaft 210 is always maintained in the same position regardless water pressure changes, and the diverting valve core 200 is in the forced diverting state. The diverting sealing pad 230 is separated from the first opening 2221 of the carrier cavity 222 adjacent to the diverting sealing pad 230, and the deformation portion 240 is separated from the second opening 2222 of the carrier cavity 222 adjacent to the deformation portion 240. A state of the pause valve core 500 is the same as the state shown in FIG. 12, the pause sealing pad 520 is in the open position, and the handheld shower water outlet passage 410 is open.

Figure 14:
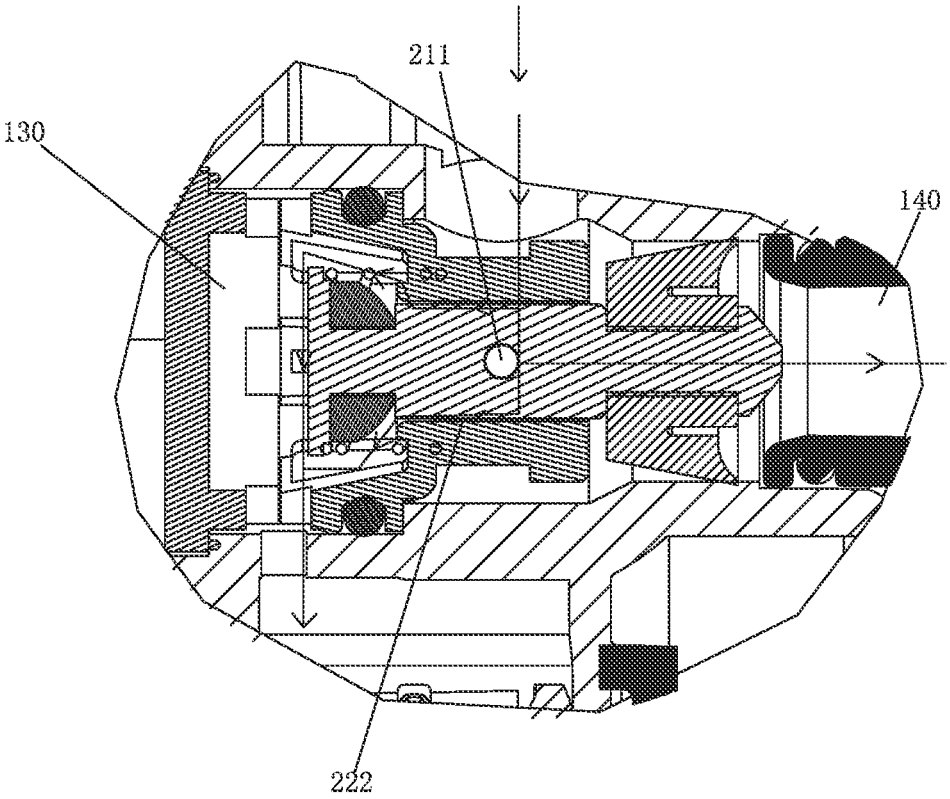
FIG. 14 illustrates a cross-sectional view of the diverting valve core in FIG. 13.

Referring to FIG. 14, a portion of water in the water inlet passage 110 flows to the top shower water outlet passage 120 through the first opening 2221 of the carrier cavity 222 adjacent to the diverting sealing pad 230, and the deformation portion 240 shrinks inward to open the inlet of the flow passage 140 due to the water pressure. Another portion of the water in the water inlet passage 110 flows into the flow passage 140 through the second opening 2222 of the carrier cavity 222 adjacent to the deformation portion 240 and flows out of both of the top shower water outlet passage 120 and the flow passage 140.

Figure 16:
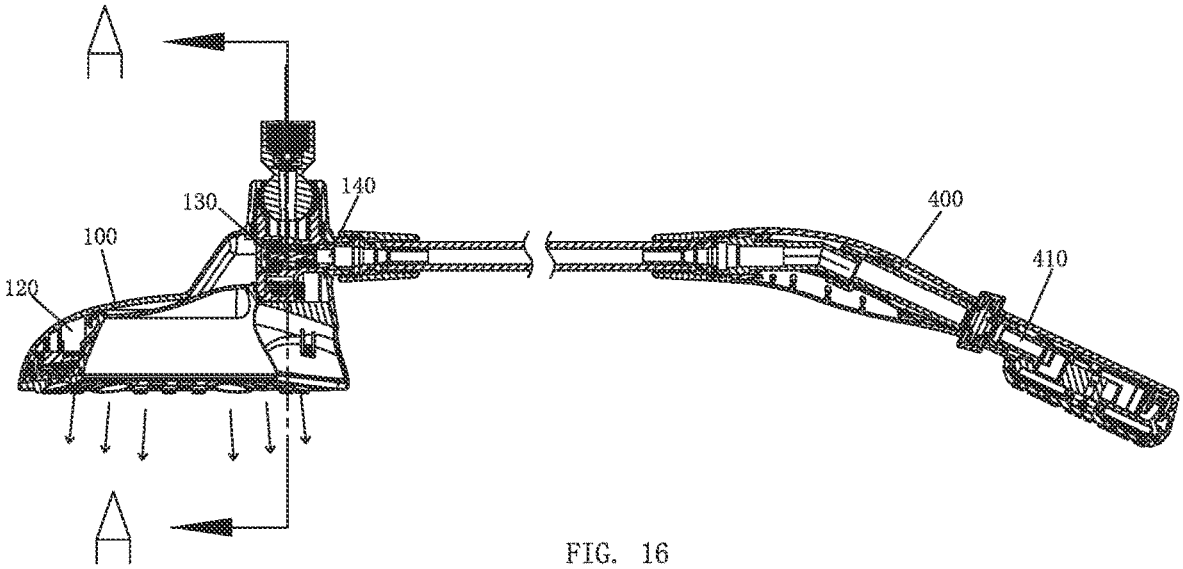
FIG. 16 illustrates a water discharging mode when the switching shaft is in the positioning position and the pause sealing pad is in the sealing position.
Figure 17:
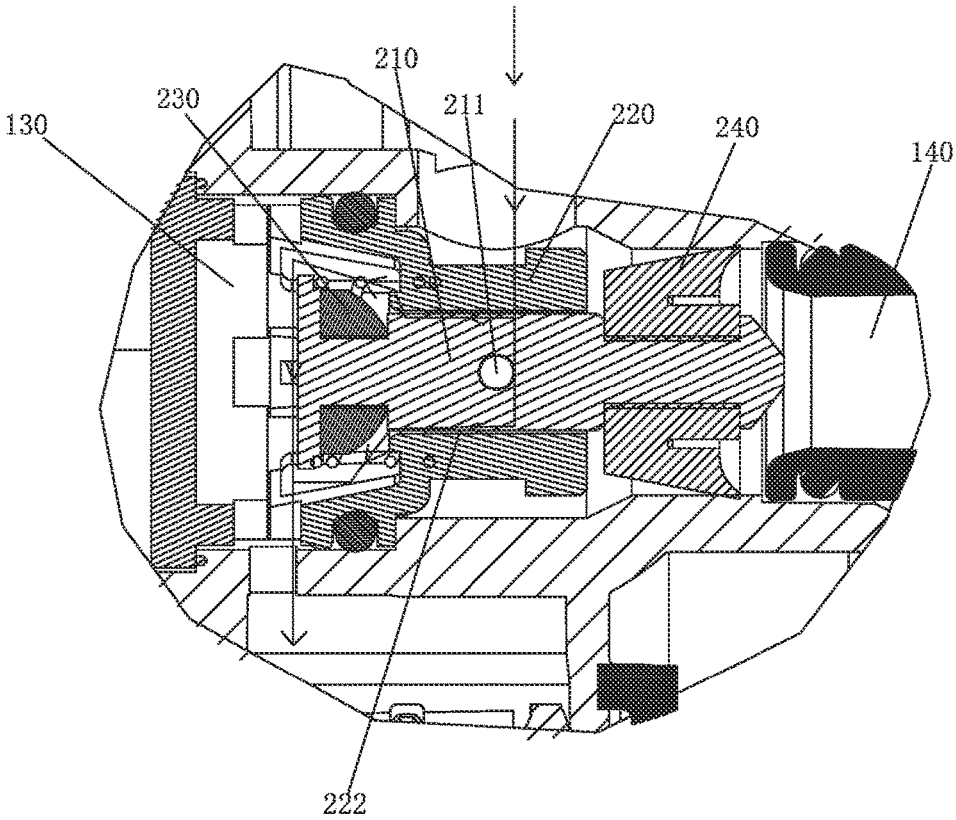
FIG. 17 illustrates a cross-sectional view of the diverting valve core in FIG. 16.

A fourth water discharging mode of the four water discharging modes is shown in FIG. 16 and FIG. 17.

A position of the switching shaft 310 is the same as the position of the switching shaft 310 shown in FIG. 15 and is in the positioning position. The diverting valve core 200 is in the forced diverting state. A state of the pause valve core 500 is the same as the state of the pause valve core 500 shown in FIG. 8, and the pause sealing pad 520 is in the sealing position.

Referring to FIG. 17, the water in the water inlet passage 110 flows into the top shower water outlet passage 120 though the first opening 2221 of the carrier cavity 222 adjacent to the diverting sealing pad 230 and flows out of the top shower water outlet passage 120.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A shower device, comprising:

a top shower, a diverting valve core, a switching assembly, a handheld shower, and a pause valve core, wherein:

the top shower comprises a water inlet passage, a top shower water outlet passage, a diverting valve cavity, and a flow passage, the water inlet passage is in communication with the top shower water outlet passage and the flow passage through the diverting valve cavity, the diverting valve core is disposed in the diverting valve cavity and comprises a normal diverting state and a forced diverting state, the switching assembly is disposed on the top shower and is configured to control the diverting valve core to be switched between the normal diverting state and the forced diverting state, the handheld shower comprises a handheld shower water outlet passage in communication with the flow passage, the pause valve core is disposed on the handheld shower to open or close the handheld shower water outlet passage the diverting valve core comprises a diverting valve shaft, the diverting valve shaft comprises a positioning portion, the switching assembly comprises a switching shaft configured to move relative to the top shower, the switching shaft moves between a separating position in which the switching shaft is separated from the positioning portion and a positioning position in which the switching shaft cooperates with the positioning portion, when the switching shaft is in the positioning position, the diverting valve shaft is secured to prevent movement of the diverting valve shaft to enable the diverting valve core to be in the forced diverting state, and when the switching shaft is in the separating position, the diverting valve shaft is configured to move to enable the diverting valve core to be in the normal diverting state due to water pressure.

2. The shower device according to claim 1, wherein:

the diverting valve core comprises a diverting valve body, a diverting sealing pad, and a deformation portion, the diverting sealing pad and the deformation portion are respectively secured to two ends of the diverting valve shaft, the diverting valve body is secured in the diverting valve cavity and comprises a diverting inlet in communication with the water inlet passage, an inner side of the diverting valve body comprises a carrier cavity, the carrier cavity penetrates through the diverting valve body and is in communication with the diverting inlet, the diverting valve shaft is configured to move along a longitudinal direction of the carrier cavity, the diverting sealing pad and the deformation portion are respectively positioned on two ends of the carrier cavity, when the diverting valve core is in the normal diverting state:

the diverting sealing pad is separated from a first opening of the carrier cavity adjacent to the diverting sealing pad and the deformation portion is hermetically disposed on a second opening of the carrier cavity adjacent to the deformation portion, or the diverting sealing pad is hermetically disposed on the first opening of the carrier cavity adjacent to the diverting sealing pad and the deformation portion is separated from the second opening of the carrier cavity adjacent to the deformation portion, and when the diverting valve core is in the forced diverting state:

the diverting sealing pad is separated from the first opening of the carrier cavity adjacent to the diverting sealing pad and the deformation portion is separated from the second opening of the carrier cavity adjacent to the deformation portion.

3. The shower device according to claim 2, wherein:

the positioning portion defines a positioning hole and cooperates with the diverting inlet, and a tail end of the switching shaft passes through the diverting inlet and cooperates with the positioning hole.

4. The shower device according to claim 3, wherein a moving direction of the switching shaft is perpendicular to a moving direction of the diverting valve shaft.

5. The shower device according to claim 3, wherein an end surface of the positioning hole facing the switching shaft comprises a guide inclined surface configured to facilitate the switching shaft being disposed in the positioning hole.

6. The shower device according to claim 3, wherein:

the handheld shower comprises a pause valve cavity, the pause valve cavity comprises a pause inlet in communication with a front end of the handheld shower water outlet passage and a pause outlet in communication with a rear end of the handheld shower water outlet passage, the pause valve core comprises a pause valve shaft movably connected to the pause valve cavity and a pause sealing pad secured to the pause valve shaft, and the pause sealing pad moves between a sealing position in which the pause outlet is hermetically sealed and an open position in which the pause outlet is open.

7. The shower device according to claim 3, wherein:

the top shower comprises a switching cavity in communication with the diverting valve cavity, the switching assembly comprises a switching base, a switching button, an upper gear shaft, a lower gear shaft, and a switching elastic member, the switching base is secured in the switching cavity, the switching button is movably connected to the switching base, the upper gear shaft is disposed in the switching base and operatively cooperates with both of the switching button and the lower gear shaft, the lower gear shaft operatively cooperates with the switching shaft, a tail end of the switching shaft is disposed in the diverting valve cavity, and the switching elastic member abuts and is disposed between the switching shaft and the switching cavity.

8. The shower device according to claim 2, wherein:

the diverting valve core comprises a diverting elastic member, and the diverting elastic member abuts and is disposed between the diverting valve shaft and the diverting valve body.

9. The shower device according to claim 2, wherein:

the handheld shower comprises a pause valve cavity, the pause valve cavity comprises a pause inlet in communication with a front end of the handheld shower water outlet passage and a pause outlet in communication with a rear end of the handheld shower water outlet passage, the pause valve core comprises a pause valve shaft movably connected to the pause valve cavity and a pause sealing pad secured to the pause valve shaft, and the pause sealing pad moves between a sealing position in which the pause outlet is hermetically sealed and an open position in which the pause outlet is open.

10. The shower device according to claim 2, wherein:

the top shower comprises a switching cavity in communication with the diverting valve cavity, the switching assembly comprises a switching base, a switching button, an upper gear shaft, a lower gear shaft, and a switching elastic member, the switching base is secured in the switching cavity, the switching button is movably connected to the switching base, the upper gear shaft is disposed in the switching base and operatively cooperates with both of the switching button and the lower gear shaft, the lower gear shaft operatively cooperates with the switching shaft, a tail end of the switching shaft is disposed in the diverting valve cavity, and the switching elastic member abuts and is disposed between the switching shaft and the switching cavity.

11. The shower device according to claim 1, wherein:

the handheld shower comprises a pause valve cavity, the pause valve cavity comprises a pause inlet in communication with a front end of the handheld shower water outlet passage and a pause outlet in communication with a rear end of the handheld shower water outlet passage, the pause valve core comprises a pause valve shaft movably connected to the pause valve cavity and a pause sealing pad secured to the pause valve shaft, and the pause sealing pad moves between a sealing position in which the pause outlet is hermetically sealed and an open position in which the pause outlet is open.

12. The shower device according to claim 11, wherein:

the pause valve cavity penetrates through the handheld shower upward and downward, the pause valve core comprises a first pause button and a second pause button, and the first pause button and the second pause button are respectively secured to an upper end and a lower end of the pause valve shaft.

13. The shower device according to claim 1, wherein:

the top shower comprises a switching cavity in communication with the diverting valve cavity, the switching assembly comprises a switching base, a switching button, an upper gear shaft, a lower gear shaft, and a switching elastic member, the switching base is secured in the switching cavity, the switching button is movably connected to the switching base, the upper gear shaft is disposed in the switching base and operatively cooperates with both of the switching button and the lower gear shaft, the lower gear shaft operatively cooperates with the switching shaft, a tail end of the switching shaft is disposed in the diverting valve cavity, and the switching elastic member abuts and is disposed between the switching shaft and the switching cavity.

* * * * *